US005623895A

United States Patent [19]

Masuda et al.

[11] Patent Number: 5,623,895

[45] Date of Patent: Apr. 29, 1997

[54] V-TYPE, MULTI-CYLINDER, TWO-CYCLE ENGINE

[75] Inventors: Tatsuyuki Masuda, Iwata; Seiichi Nishimura, Hamamatsu, both of Japan

[73] Assignee: Yamaha Hatsudoki Kabushiki Kaisha, Iwata, Japan

[21] Appl. No.: 384,510

[22] Filed: Feb. 6, 1995

[30] Foreign Application Priority Data

Feb. 7, 1994 [JP] Japan ..... 6-013404

[51] Int. Cl.[6] ..... F02B 33/04

[52] U.S. Cl. ..... 123/54.4; 123/73 V; 123/73 R

[58] Field of Search ..... 123/73 V, 73 PP, 123/65 R, 73 R, 73 A, 73 C, 54.4

[56] References Cited

U.S. PATENT DOCUMENTS

| | | | |
|---|---|---|---|
| 2,067,715 | 1/1937 | Kylen . | |
| 2,639,699 | 5/1953 | Kiekhaefer . | |
| 3,166,054 | 1/1965 | Conover | 123/73 V |
| 3,815,559 | 6/1974 | Anderson | 123/73 V |
| 4,589,382 | 5/1986 | Tsuboi | 123/54.4 |
| 4,690,109 | 9/1987 | Ogasahara et al. | 123/73 A |
| 4,879,974 | 11/1989 | Alvers | 123/51 A |
| 4,892,066 | 1/1990 | Brown | 123/73 V |
| 4,898,127 | 2/1990 | Phillips et al. | 123/73 A |
| 5,251,584 | 10/1993 | Ohkubo | 123/73 V |

FOREIGN PATENT DOCUMENTS

| | | |
|---|---|---|
| 0060802 | 9/1982 | European Pat. Off. . |
| 469596 | 5/1992 | European Pat. Off. . |
| 2855445 | 7/1979 | Germany . |
| 51-79818 | 7/1976 | Japan . |
| 56-11624 | 3/1981 | Japan . |
| 59-18229 | 1/1984 | Japan . |
| 1105726 | 7/1989 | Japan . |
| 2022699 | 12/1979 | United Kingdom . |

*Primary Examiner*—David A. Okonsky

*Attorney, Agent, or Firm*—Knobbe, Martens, Olson & Bear LLP

[57] ABSTRACT

An improved scavenging control system for a multi-cylinder, V-type, two-cycle crankcase compression internal combustion engine. In each embodiment, a scavenging manifold extends along one side of the crankcase chamber and communicates with the individual sealed sections therein through respective scavenging control passages. A plurality of butterfly-type throttle valves controls the communication between the crankcase chamber and the scavenging manifold and these valves are all affixed on a common valve shaft. In one embodiment, the scavenge control system is disposed in the valley between the cylinder banks and in the other illustrated embodiment, the scavenging system is disposed on one side of the crankcase and outside of the valley between the cylinder banks.

29 Claims, 5 Drawing Sheets

V-TYPE, MULTI-CYLINDER, TWO-CYCLE ENGINE

BACKGROUND OF THE INVENTION

This invention relates to a V-type, multi-cylinder, two-cycle engine and more particularly to an improved scavenging system for a crankcase compression engine of this type.

There have been proposed arrangements wherein the amount of scavenging flow for a two-cycle engine having multiple cylinders can be controlled by utilizing a scavenge manifold which is communicated with the individual crankcase chambers of the engine associated with each cylinder through respective scavenge control passages. Scavenge control throttle valves are positioned in these scavenge control passages and are movable between a closed position, wherein normal scavenging of the engine is achieved and an open position wherein the amount of scavenging airflow is reduced. This reduces the likelihood of exhaust gases passing back into the crankcase chambers from the scavenge passages.

Such an arrangement is described in detail in U.S. Pat. No. 5,251,584 issued Oct. 12, 1993 to one of the assignees hereof. FIG. 1 is a cross-sectional view taken of one cylinder of a multi-cylinder engine constructed in accordance with that invention and is, in part, similar to FIG. 14 thereof.

As seen in this figure, a prior art engine is identified generally by the reference numeral 11 include a cylinder block 12 having a plurality of aligned cylinder bores 13, only one of which is shown. Pistons 14 reciprocate in the cylinder bores 13 and are connected by means of connecting rods 15 to a crankshaft 16. The crankshaft 16 is rotatably journaled within a crankcase chambers 17 formed by a skirt 18 of the cylinder block 12 and a crankcase member 19 that is affixed to the cylinder block skirt 18 in a known manner. As is typical with two-cycle crankcase compression engines, the crankcase chamber 17 associated with each of the cylinder bores 13 are sealed from each other.

An atmospheric air inlet charge is delivered to the crankcase chamber 17 from an intake manifold shown partially and identified by the reference numeral 21. This intake manifold 21 serves intake ports 22 that cooperate with each of the crankcase chambers 17 for admitting a charge thereto. A reed-type check valve 23 is positioned in each intake port 22 so as to permit the air to flow into the crankcase chambers 17 when the pistons 14 are moving upwardly but to preclude reverse flow when the pistons 14 move downward.

This downward movement causes the air charge to be compressed in the crankcase chamber 17 and the flow then is transferred to the combustion chamber 24 formed in a manner which will be described, through one or more scavenge passages 25.

The combustion chamber 24 is defined by the cylinder bore 13, the head of the piston 14, and by a cylinder head assembly 26 that is affixed to the cylinder block 12 in a known manner. In the illustrated embodiment, the engine 11 is of the diesel type and thus includes a pre-combustion chamber 27 formed in the cylinder head assembly 26 and which communicates with the main combustion chamber 24 through a restricted throat 28.

As the piston 14 continues its upward movement, the charge which has been transferred to the combustion chamber 24 and through the throat 28 to the pre-chamber 27 will be further compressed.

A fuel injector 29 is mounted in the cylinder head assembly 26 and sprays fuel into the pre-chamber 27 and through the throat 28 into the main combustion chamber 24 at the appropriate time. This charge will immediately commence to burn because of the high pressure and temperature. This will cause expansion both of the gases in the pre-chamber 27 and in the main chamber 24 while combustion continues to drive the pistons 14 downward.

If desired, glow plugs 31 may be mounted in the cylinder head assembly 26 and extend into the pre-chamber 27 to assist in ignition, during at least cold running operation.

The exhaust gases then exit through an exhaust passage 31 formed in the cylinder block 12 and which communicates with an exhaust manifold 33 for discharge of these exhaust gases to the atmosphere. An exhaust control valve 34 may also be provided in an auxiliary exhaust passage 35 so as to vary the effective compression ratio of the engine 11 as is known in this art.

The scavenge control system includes a scavenge manifold 36 which extends along the side of the engine and which communicates with each crankcase chamber 17 through a respective scavenge control passage 37. Scavenge control throttle valves 38 are supported on a throttle valve shaft 39 in the scavenge control passages 37 and control the communication of the chamber 17 with the scavenge control manifold 36.

When the scavenge control valves 38 are in their closed position as shown in FIG. 1, the engine 11 operates with normal scavenging. However, under low-speed and low-load conditions, the scavenge control valves 38 may be opened and thus reduce the pressure in the crankcase chambers 17 during downward movement of the pistons and thus reduce the amount of scavenging airflow into the combustion chambers 24 to achieve the aforenoted results.

Obviously, this type of arrangement is quite useful in scavenge control, particularly in diesel engines and those embodying direct cylinder injections. However, this principle has been primarily limited to use in in-line type engines because of the difficulty in providing adequate scavenge control between all of the crankcase chambers of a V-type engine.

It is, therefore, a principal object of this invention to provide an improved scavenge control system for an engine having angularly related cylinder banks.

It is a further object of this invention to provide an improved scavenge control system for a V-type, multi-cylinder, crankcase compression engine.

SUMMARY OF THE INVENTION

This invention is adapted to be embodied in a scavenge control system for a crankcase compression internal combustion engine having a pair of angularly-related cylinder banks each containing a plurality of cylinder bores. A crankcase chamber from which the cylinder banks radiate has a plurality of sealed chamber sections each associated with a respective cylinder bore. A scavenge manifold extends along one side of the crankcase chamber. A plurality of scavenging passages each extend from one of the crankcase chamber sections to the scavenging manifold. Valve means control the communication of the crankcase chamber sections with the scavenge manifold for controlling the amount of scavenging.

DETAILED DESCRIPTION OF THE PREFERRED EMBODIMENTS OF THE INVENTION

Figure 2:
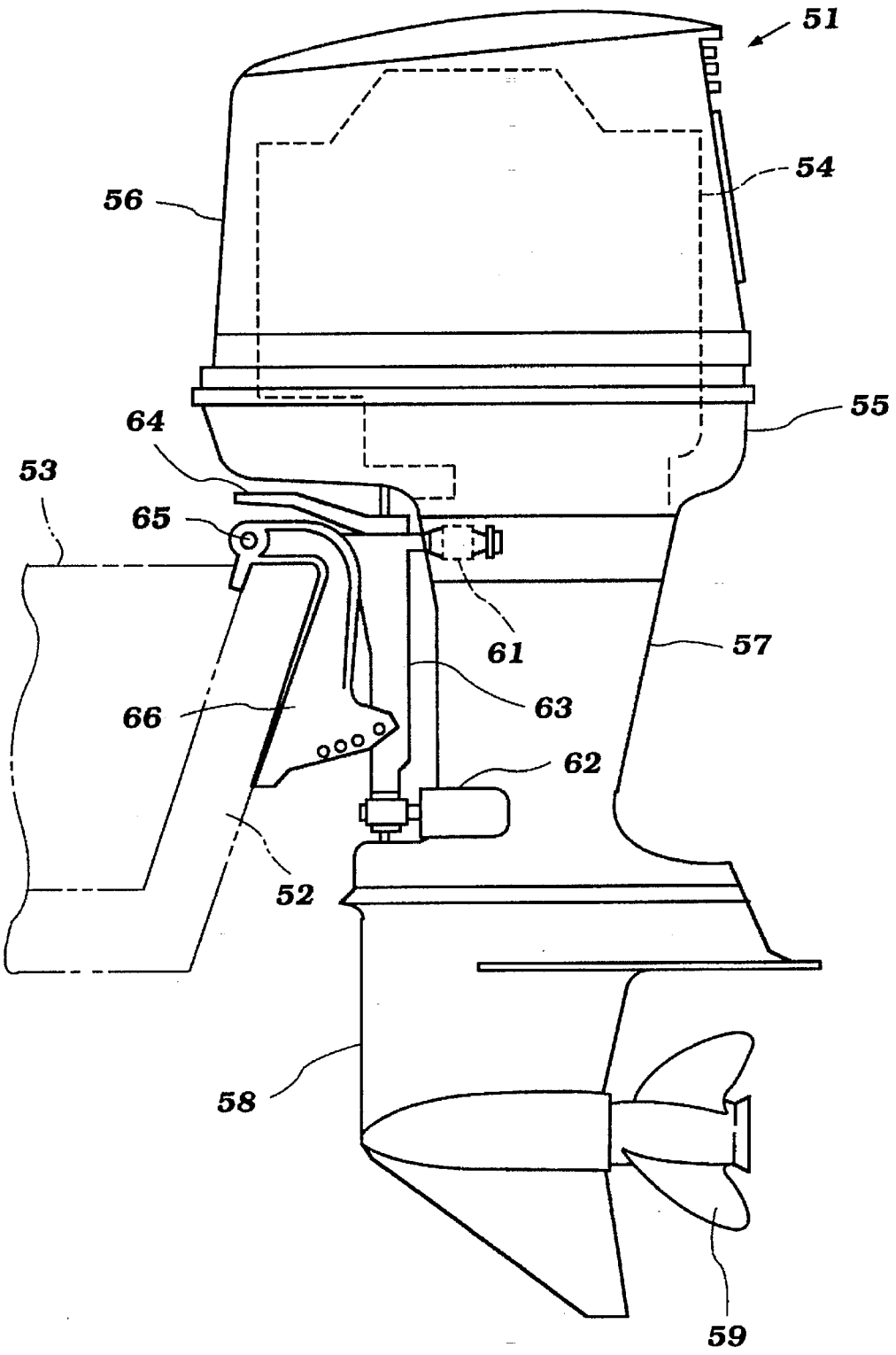
FIG. 2 is a side elevational view of an outboard motor attached to the transom of a watercraft shown partially and in phantom.

Referring now initially to FIG. 2, an outboard motor constructed in accordance with an embodiment of the invention is identified generally by the reference numeral 51 and is shown as attached to the transom 52 of a watercraft 53, shown partially and in phantom. The invention is described in conjunction with an outboard motor 51 because such an application is a typical environment in which the invention may be practiced. It is to be understood, however, that the invention is adapted for use in any of a wide variety of applications for two-cycle crankcase compression engines having angularly disposed cylinder banks. However, outboard motors are one application where this type of invention has particular utility particularly because of the compact nature required for the power plants of outboard motors.

The outboard motor 51 is comprised of a power head having a powering internal combustion engine 54 the details of which will be described later by more reference to FIGS. 3 and 4. This power head further includes a protective cowling comprised of a lower tray portion 55 to which a detachable main cowling portion 56 is connected.

As is typical with outboard motor practice, the engine 54 is disposed on the tray 55 so that its crankshaft rotates about a vertically extending axis. The crankshaft is rotatably coupled to a drive shaft (not shown) which depends into and is journaled within a drive shaft housing 57. This drive shaft continues through the drive shaft housing 57 into a lower unit 58 where it drives a propeller 59 through a conventional forward, neutral, reverse transmission (not shown).

A steering shaft, not shown, is connected to the drive shaft housing 57 by upper and lower bracket assembly 61 and 62. This steering shaft is journaled for steering movement within a swivel bracket 63 in a well known manner for steering of the outboard motor 51 and associated watercraft 53. A tiller 64 is affixed to the upper end of the steering shaft for effecting the steering of the outboard motor 51.

The swivel bracket 63 is connected by means of a pivot pin 65 to a clamping bracket 66. This pivotal connection permits tilt and trim movement of the outboard motor 51 as is also well known in this art. The clamping bracket 61 provides a suitable mechanism whereby the outboard motor 51 as thus far described may be detachably connected to the watercraft transom 52.

As has been noted, the construction of the outboard motor 51 is intended to show an environment in which the invention is particularly adapted for use. Since the invention deals primarily with the construction of the internal combustion engine 54, further details of the construction of the outboard motor 51 are not believed to be necessary to permit those skilled in the art to practice the invention. Where any details of the outboard motor 51 are not described, they may be considered to be conventional.

Figure 1:
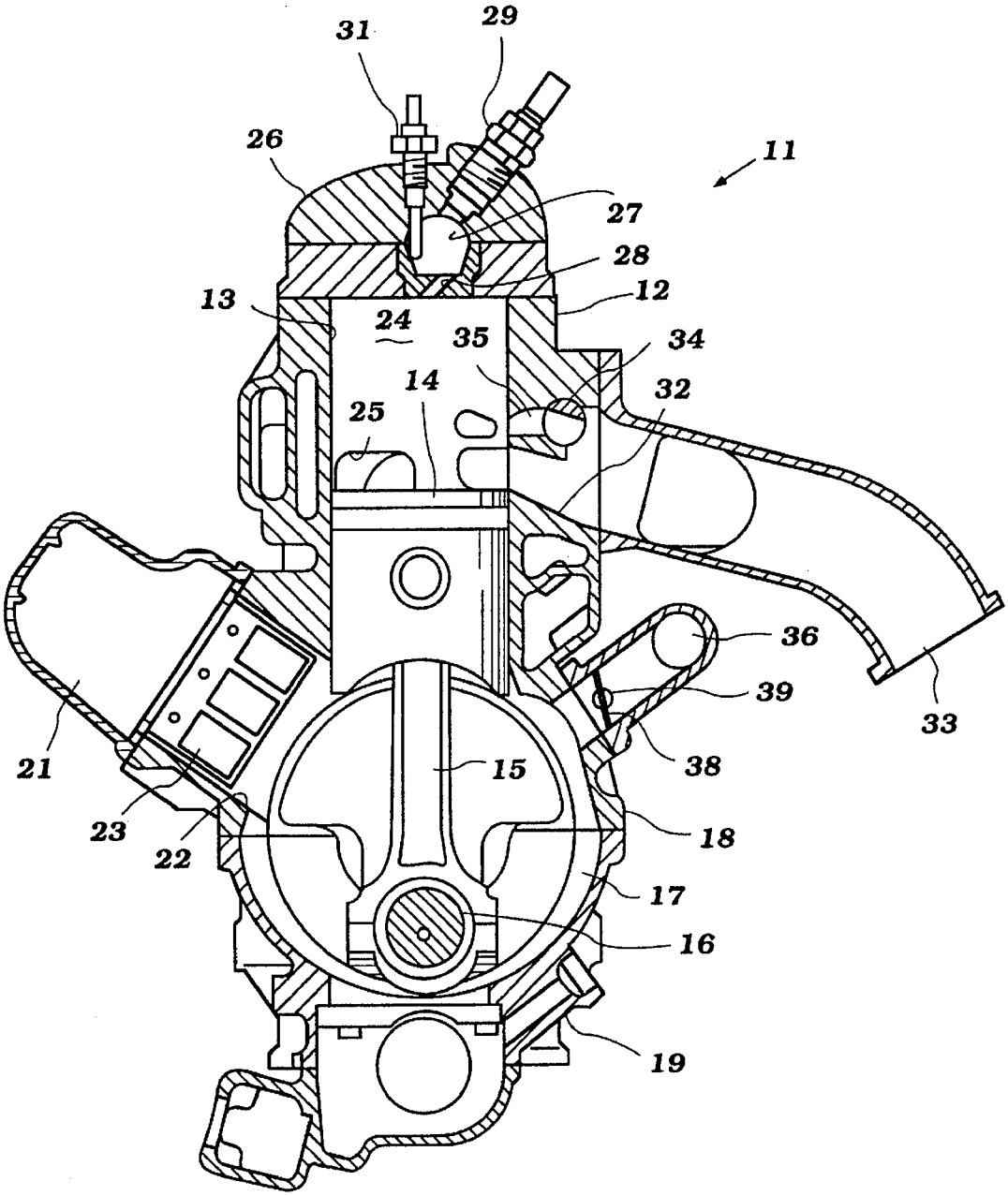
Figure 1 Prior Art
FIG. 1 is a cross-sectional view taken through a single cylinder of a multiple cylinder internal combustion engine constructed in accordance with the prior art and wherein the engine in an in-line type engine.

The construction of the engine 54 will now be described by particular reference to FIGS. 3 and 4. In many regards, the engine 54 is the same as the prior art type of construction as shown in FIG. 1 and where that is the case, components of the engine 54 which are the same as the prior art type of construction have been identified by the same reference numerals.

In this embodiment, the cylinder block 12 is provided with a pair of angularly disposed cylinder banks 67 and 68 which are disposed at a V-angle to each other and which define a valley therebetween. As is well known with V-type engine practice, the cylinder banks 67 and 68 are staggered relative to each other so that the connecting rods 15 of adjacent cylinder bores 13 may be disposed in side-by-side relationship on the throws of the crankshaft 16. In the illustrated embodiment, each cylinder bank 67 and 68 is provided with a plurality of cylinder bores 13 and in this particular embodiment, three cylinder bores are formed for each cylinder bank. It should be readily apparent to those skilled in the art, however, how the invention may be employed with other numbers of cylinders.

The valley between the cylinder bank 67 and 68 contains a pair of exhaust manifolds 69 which communicate with the exhaust passages 32 of each cylinder bank 67 and 68 for delivering the exhaust gasses downwardly through the drive shaft housing 57 for discharge through a conventional underwater exhaust gas discharge, as is typically employed in this art.

As with the prior art type of constructions, the crankcase chamber 17 associated with each cylinder bore 13 is sealed from the others in any appropriate manner.

The induction system for the engine 54 includes an air inlet device 71 having a pair of forwardly facing inlet openings 72 through which atmospheric air can be drawn from within the protective cowling. The main cowling member 56 is provided with an atmospheric air inlet (not shown) for admitting sufficient air for engine operation.

The air inlet device 71 transfers the air that it has inducted to an intake manifold 73 that has branched runner portions 74 that communicate with the intake ports 22 for each crankcase chamber section 17. As with the prior art type of constructions, read type check valves 75 are provided in each of the intake ports 22 for permitting air to flow into the crankcase chamber sections 17, but which preclude reverse flow when the charge is being compressed therein.

Since the scavenge passages and exhaust passages are the same as conventional engines, except as heretofore noted, another description of the conventional portion of the engine is not believed to be necessary.

In accordance with the invention, a scavenge manifold 76 is formed by a volume that is defined by the portion of the cylinder block 12 in the valley between the cylinder banks 67 and 68 and inwardly of the exhaust manifolds 69 and by these manifolds 69. A plurality of scavenge control passages 77 are also formed in the cylinder block 12 and in the valley between the cylinder bank 67 and 68. These scavenge control passages 77 each communicate with a respective crankcase chamber section 17. The scavenge control passages extend into the scavenge manifold cavity 76 to provide a compact construction.

Scavenge controlling throttle valves 78 are provided on a common scavenge control valve shaft 79 that extends through the cylinder block in the area adjacent the scavenge manifold 77. A control lever 81 is affixed to the upper end of the scavenge control valve shaft 79 for connection to an appropriate servo motor so as to open and close the scavenge control valves 78 in accordance with any desired control routine. Hence, it should be readily apparent that this construction provides a very compact scavenge arrangement while still maintaining all of the advantages of scavenge control in the manner as previously used only with in-line type engines.

The cylinder block 12 is also provided with a water cooling jacket, a portion of which, indicated by the reference numeral 82, is juxtaposed to the exhaust manifold 69 for cooling not only them, but the scavenge control manifold 76.

Figure 3:
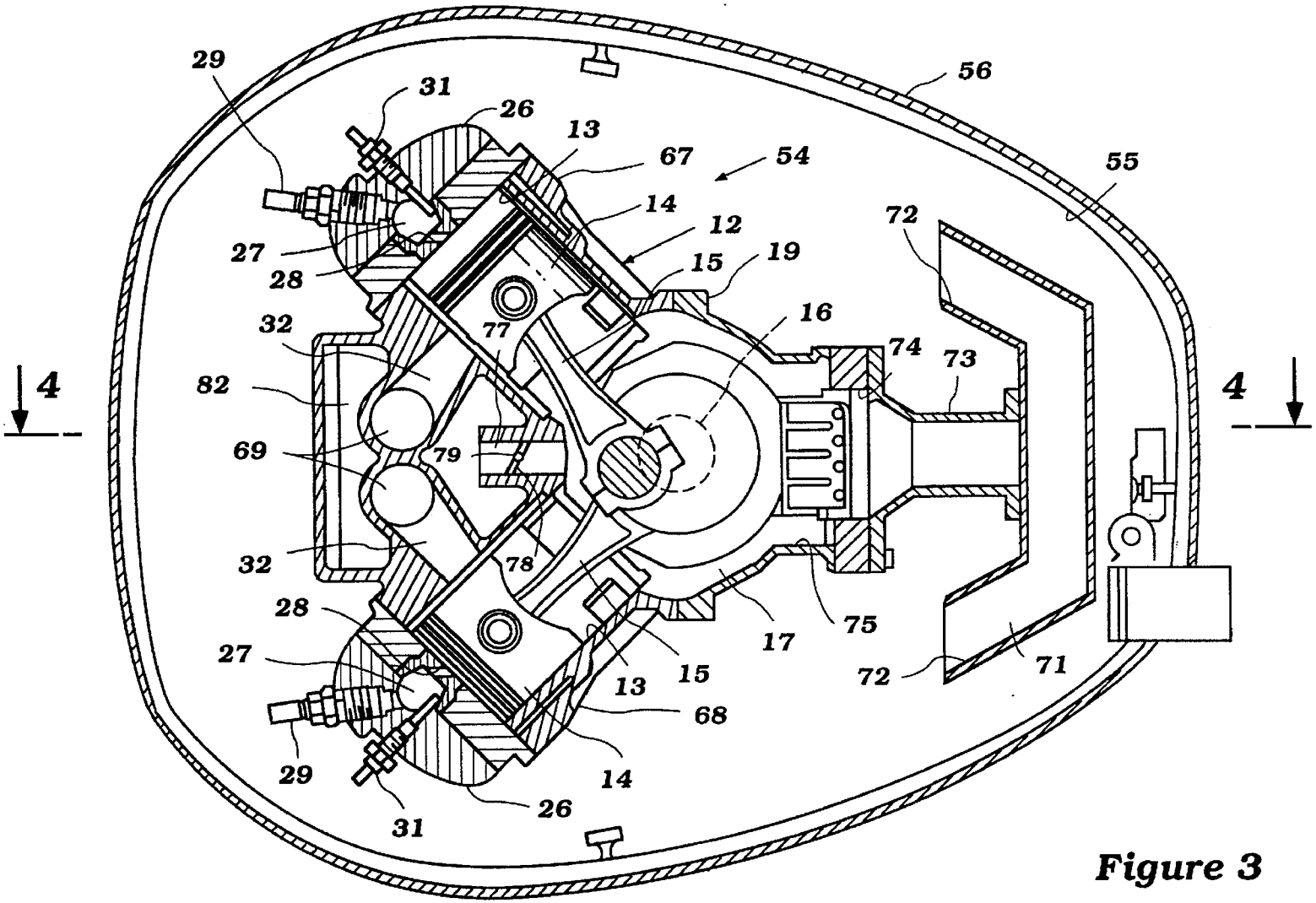
FIG. 3 is a cross-sectional view taken along a horizontal plane and on an enlarged scale of the outboard motor shown in FIG. 2.
Figure 4:
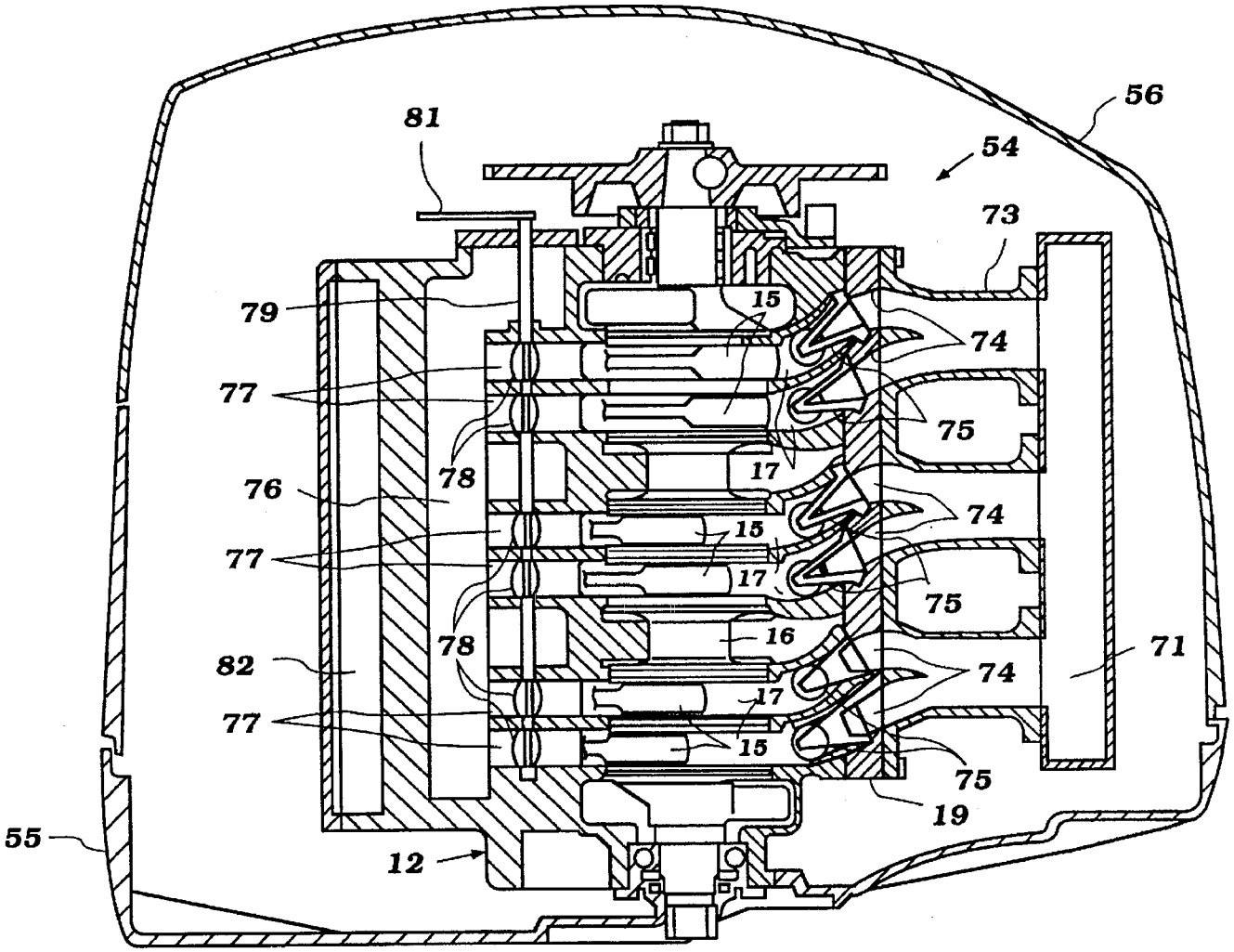
FIG. 4 is a cross-sectional view taken along the line 4—4 of FIG. 3.
Figure 5:
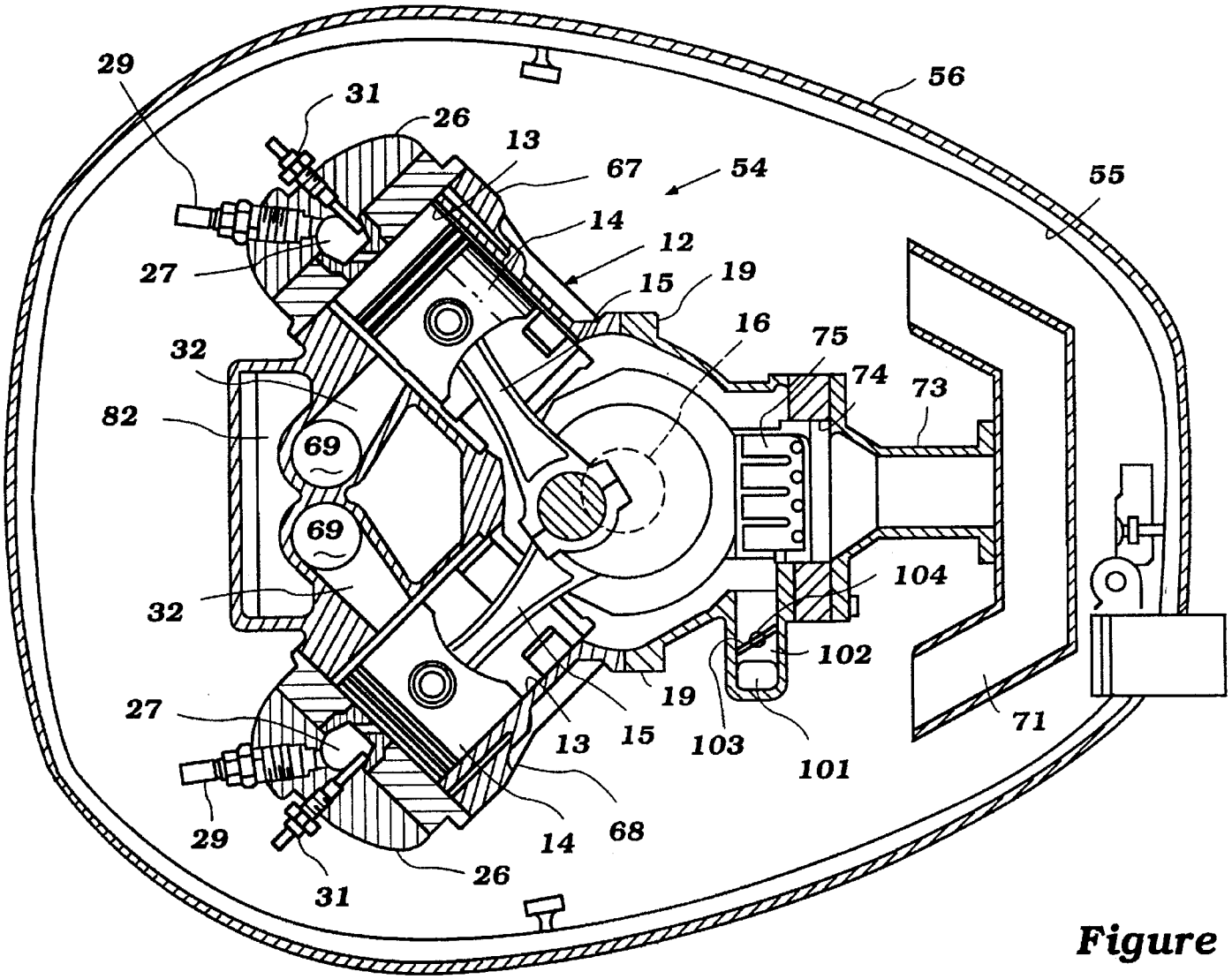
FIG. 5 is a cross-sectional view, in part similar to FIG. 3, and shows another embodiment of the invention.

FIG. 5 shows another embodiment of the invention which is generally the same as the embodiment of FIGS. 3 and 4. For that reason, only the differences between this embodiment and that previously described embodiment will be described in detail. Where components are the same, they have been identified by the same reference numerals and will be described again only insofar as necessary to understand the construction and operation of this embodiment.

This embodiment differs from the previously described embodiment in that a scavenge manifold, indicated generally by the reference numeral 101 is disposed outside of the valley area between the cylinder banks 67 and 68. This scavenge manifold 101 is disposed on one side of the lower end of the crankcase member 19.

As with the previous construction, the scavenge manifold 101 communicates with the individual crankcase chamber 17 through scavenge control passages 102. These scavenge control passages 102 are all aligned with each other and each has a scavenge control throttle valve 103 disposed therein. The scavenge control throttle valves 103 are all affixed to a common scavenge control valve shaft 104 that extends parallel to the rotational axis of the crankshaft 16 on one side of the crankcase chamber 17. Thus, this embodiment, like the previously described embodiment, permits the use of a single scavenge control manifold for both banks of a V-type engine or engine having angularly related cylinder banks.

From the foregoing description, it should be readily apparent that the described constructions provide a very compact V-type, two-cycle, crankcase compression engine wherein a single scavenge manifold serves both cylinder banks and permits a scavenge valve arrangement wherein a single aligned throttle valve shaft controls the flow through all scavenge control passages. Of course, the foregoing description is that of a preferred embodiment to the invention and as will be readily apparent to those skilled in the art, various changes and modifications may be made without departing from the spirit and scope of the invention, as defined by the appended claims.

We claim:

1. A scavenge control system for a V-type crankcase compression internal combustion engine having a pair of angularly related cylinder banks each containing a plurality of cylinder bores, a crankcase chamber from which said cylinder banks radiate and having a plurality of sealed chamber sections each associated with a respective cylinder bore, a single scavenging manifold extending along one side of said crankcase chamber, a plurality of scavenging control passages each extending from a respective one of said crankcase chamber sections into said scavenging manifold, and valve means for controlling the communication of each of said crankcase chamber sections with said scavenging manifold.

2. A scavenge control system for a V-type crankcase compression internal combustion engine as set forth in claim 1, wherein the cylinder banks are disposed at a V-angle to each other and define a valley therebetween.

3. A scavenge control system for a V-type crankcase compression internal combustion engine as set forth in claim 2, wherein the scavenging manifold extends in the valley between the cylinder banks.

4. A scavenge control system for a V-type crankcase compression internal combustion engine as set forth in claim 3, wherein the scavenging manifold is formed in part by the facing surfaces of the cylinder banks.

5. A scavenge control system for a V-type crankcase compression internal combustion engine as set forth in claim 4, wherein the scavenging control passages extend in part into the scavenging manifold.

6. A scavenge control system for a V-type crankcase compression internal combustion engine as set forth in claim 5, wherein the valve means are positioned in the portion of the scavenging control passages that extend into the scavenging manifold.

7. A scavenge control system for a V-type crankcase compression internal combustion engine as set forth in claim 6, further including a pair of exhaust manifolds extending into the valley from the respective cylinder banks for receiving the exhaust gases from the cylinder bores therein.

8. A scavenge control system for a V-type crankcase compression internal combustion engine as set forth in claim 7, wherein the scavenging manifold is further formed by the exhaust manifold.

9. A scavenge control system for a V-type crankcase compression internal combustion engine as set forth in claim 3, further including a pair of exhaust manifolds extending into the valley from the respective cylinder banks for receiving the exhaust gases from the cylinder bores therein.

10. A scavenge control system for a V-type crankcase compression internal combustion engine as set forth in claim 9, wherein the scavenging manifold is further formed by the exhaust manifold.

11. A scavenge control system for a V-type crankcase compression internal combustion engine as set forth in claim 2, wherein the scavenging manifold extends along an area outside of the valley between the cylinder banks.

12. A scavenge control system for a V-type crankcase compression internal combustion engine as set forth in claim 11, wherein the scavenging manifold extends along one side of the crankcase chamber adjacent a respective cylinder bank.

13. A scavenge control system for a V-type crankcase compression internal combustion engine as set forth in claim 1, wherein the valve means comprise a plurality of butterfly-type valves.

14. A scavenge control system for a V-type crankcase compression internal combustion engine as set forth in claim 13, wherein there is provided one butterfly-type valve in each scavenging control passage.

15. A scavenge control system for a V-type crankcase compression internal combustion engine as set forth in claim 14, wherein all of the butterfly-type scavenge control valves are supported on a common shaft.

16. A scavenge control system for a V-type crankcase compression internal combustion engine as set forth in claim 15, wherein the cylinder banks are disposed at a V-angle to each other and define a valley therebetween.

17. A scavenge control system for a V-type crankcase compression internal combustion engine as set forth in claim 16, wherein the scavenging manifold extends in the valley between the cylinder banks.

18. A scavenge control system for a V-type crankcase compression internal combustion engine as set forth in claim 17, wherein the scavenging manifold is formed in part by the facing surfaces of the cylinder banks.

19. A scavenge control system for a V-type crankcase compression internal combustion engine as set forth in claim 18, wherein the scavenging control passages extend in part into the scavenging manifold.

20. A scavenge control system for a V-type crankcase compression internal combustion engine as set forth in claim 19, wherein the valve means are positioned in the portion of the scavenging control passages that extend into the scavenging manifold.

21. A scavenge control system for a V-type crankcase compression internal combustion engine as set forth in claim 20, further including a pair of exhaust manifolds extending into the valley from the respective cylinder banks for receiving the exhaust gases from the cylinder bores therein.

22. A scavenge control system for a V-type crankcase compression internal combustion engine as set forth in claim 21, wherein the scavenging manifold is further formed by the exhaust manifold.

23. A scavenge control system for a V-type crankcase compression internal combustion engine as set forth in claim 18, further including a pair of exhaust manifolds extending into the valley from the respective cylinder banks for receiving the exhaust gases from the cylinder bores therein.

24. A scavenge control system for a V-type crankcase compression internal combustion engine as set forth in claim 23, wherein the scavenging manifold is further formed by the exhaust manifold.

25. A scavenge control system for a V-type crankcase compression internal combustion engine as set forth in claim 16, wherein the scavenging manifold extends along an area outside of the valley between the cylinder banks.

26. A scavenge control system for a V-type crankcase compression internal combustion engine as set forth in claim 25, wherein the scavenging manifold extends along one side of the crankcase chamber adjacent a respective cylinder bank.

27. A scavenge control system for a V-type crankcase compression internal combustion engine as set forth in claim 1, further including a piston slidably supported in each of the cylinder bores, a single crankshaft rotatably journaled within the crankcase chamber, and a plurality of connecting rods, each connecting a respective one of said pistons to said crankshaft for driving said crankshaft.

28. A scavenge control system for a V-type crankcase compression internal combustion engine as set forth in claim 27, wherein the engine comprises a direct fuel injected engine including a plurality of fuel injectors, each injecting fuel into a respective combustion chamber formed by a respective cylinder bore and piston.

29. A scavenge control system for a V-type crankcase compression internal combustion engine as set forth in claim 28, wherein the engine operates on a diesel principle.

* * * * *